US005201197A

United States Patent [19]

Bakker

[11] Patent Number: 5,201,197

[45] Date of Patent: Apr. 13, 1993

[54] PIERCED EARRING MOUNT LOCKING MEMBER

[76] Inventor: Johann G. Bakker, 11038 Moorpark St., North Hollywood, Calif. 91602

[21] Appl. No.: 890,832

[22] Filed: Jun. 1, 1992

[51] Int. Cl.[5] ..... A44C 7/00

[52] U.S. Cl. ..... 63/12

[58] Field of Search ..... 63/12, 13; 24/705

[56] References Cited

U.S. PATENT DOCUMENTS

| | | | |
|---|---|---|---|
| 396,661 | 1/1889 | Luthy | 63/12 |
| 398,787 | 2/1889 | Luthy | 24/705 |
| 459,476 | 9/1891 | Bulova | 63/12 |
| 502,801 | 8/1893 | Wodiska . | |
| 527,359 | 10/1894 | Bonner . | |
| 4,003,216 | 1/1977 | Cecere et al. | 63/12 |
| 4,218,894 | 8/1980 | Tropea | 63/13 |
| 4,249,393 | 2/1981 | Ciambra | 63/12 |
| 4,543,804 | 10/1985 | Cappiello | 63/12 |
| 4,653,292 | 3/1987 | Maupin et al. | 63/12 |
| 4,907,424 | 3/1990 | Reinstein | 63/12 |
| 5,020,338 | 6/1991 | Payne et al. | 63/12 |
| 5,097,681 | 3/1992 | Steele | 63/12 |

FOREIGN PATENT DOCUMENTS

| | | | |
|---|---|---|---|
| 474217 | 11/1914 | France | 63/12 |
| 25343 | of 1909 | United Kingdom | 63/12 |
| 2099289 | 12/1982 | United Kingdom | 63/12 |

*Primary Examiner*—Peter M. Cuomo
*Assistant Examiner*—Michael J. Milano
*Attorney, Agent, or Firm*—Harlan P. Huebner

[57] ABSTRACT

A single post and locking member for a pierced earring that is self contained having a first section projecting from an earring base member and a second section extending from the first section normal thereto, both sections adapted to pass through an ear lobe and a locking member shiftable in the second section to lock the earring within the ear.

6 Claims, 1 Drawing Sheet

10
12
14
16
18
20
22
24
26
32
34
36
38
40
42
44
46
48
50
52
54
56
58
60
62
64
2
2

PIERCED EARRING MOUNT LOCKING MEMBER

BACKGROUND OF THE INVENTION

1. Field of the Invention

This invention relates to a pierced earring mount locking member and more particularly to a locking member that is self contained not requiring additional holding means.

2. Description of the Prior Art

The usual structure for securing a pierced earring mount to the lobe of an ear is a solid elongated shaft or post that has a point that passes through the ear lobe and there is a locking or holding nut that slidably moves over the pointed end onto the shaft. The disadvantage of such construction is that with continued use the locking or holding nut begins to wear, particularly where a heavy content of gold is present in the mounting causing slippage of the nut and eventual detachment with the possibility of loss of the mount.

Other prior art shafts or posts are threaded and the locking or holding nuts are threaded. This is not only a relative expensive fabrication process but also due to the reduced size of the post it is easy to misalign the threads stripping them causing the detachment of the post from the nut and possible loss of the pierced earring mount.

Also the applicant is aware of another form of post that is hooked and passes through the ear lobe. Such structure has the disadvantage of having no fasteners or locking means and with strenuous exercising and dancing the earring may come off.

SUMMARY OF THE INVENTION

It is an object of the present invention to provide a single post and locking member for a pierced earring that is simple to insert and lock in an ear lobe.

Another object of the present invention is to provide a single post and locking member for a pierced earring that includes a shiftable locking element that is movable from a first insertion position to a second locking position.

A still further object of the present invention is to provide a single post and locking member for a pierced earring that includes a bend in the post so that after insertion into the ear lobe the post and locking member is bend at right angles to entry, positioning a part of the post parallel with the back of the ear lobe.

A yet further object of the present invention is to provide a single post and locking member for a pierced earring wherein a shiftable locking element mounted in at least a part of the locking element is constructed to bias against the post to prevent dislodgment.

Another object of the present invention is to provide a single post and locking member for a pierced earring that is secured to an earring which depends therefrom to form a complete ready to wear pierced ear earring.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figures 1, 2, 3, 4:
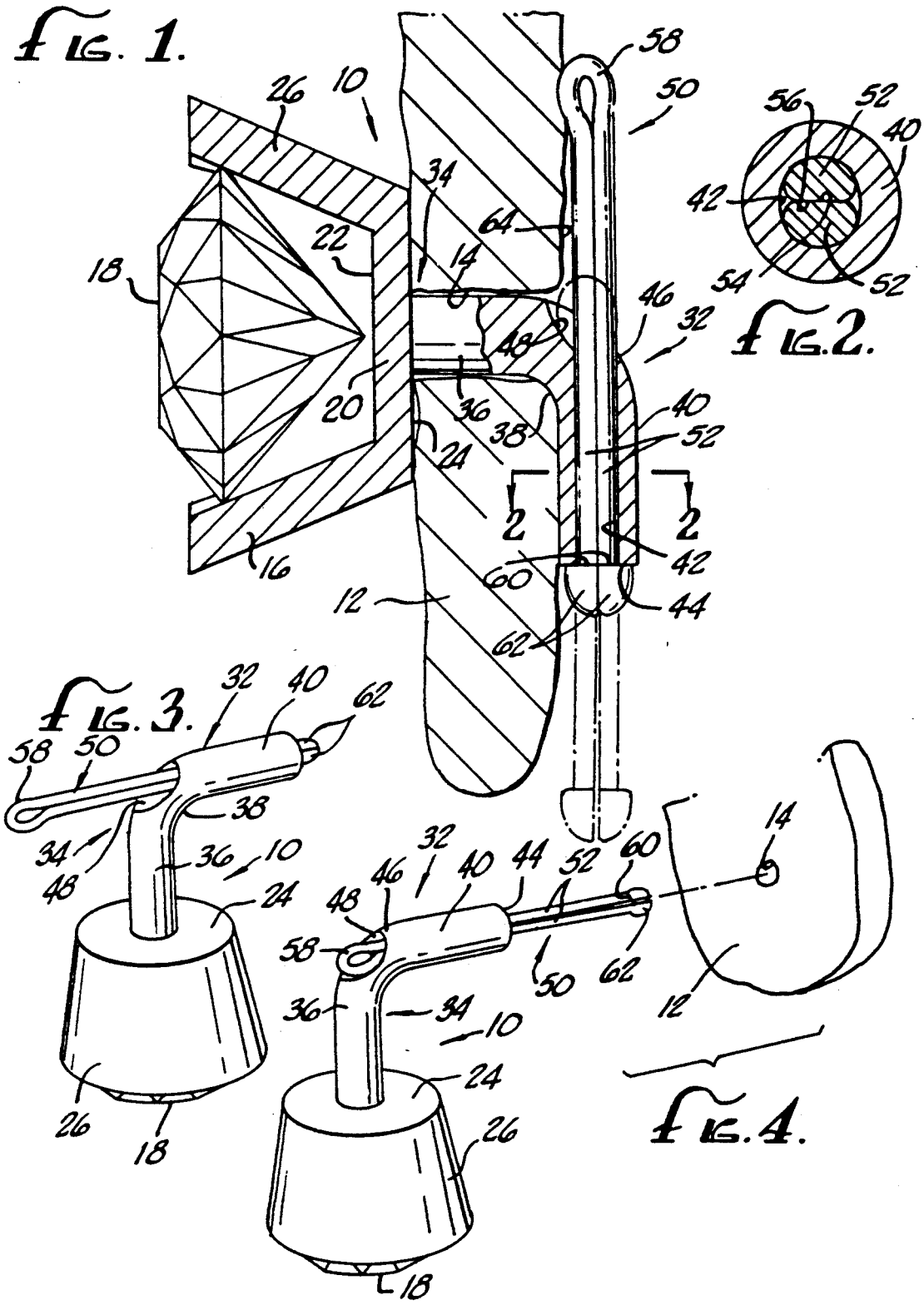
FIG. 1 is an enlarged cross-sectional side elevational view of the present invention mounted in an ear lobe.
FIG. 2 ia a cross-sectional view taken on line 2—2 of FIG. 1.
FIG. 3 is perspective view of the present invention as it would be when locked in an ear lobe.
FIG. 4 is a perspective view similar to FIG. 3 but with the invention in position for insertion through an ear lobe.

There is illustrated in FIGS. 1, 3 and 4 an earring generally designated 10 adapted for use with a pierced ear such as a human ear lobe 12. The lobe 12 is prepared by any conventional means with an opening 14 to receive the earring 10.

The earring 10 may include any type of conventional mounting or base member 16 such as for a precious or semi-precious stone 18 that includes a backing element 20 with a front and rear surface 22 and 24 and holding prongs or cup 26. The earring 10 may also be any of a myriad of designs that hang from, extend from or project from some type of a base.

The invention resides in the following locking and holding member generally designated 32. Extending from the back surface 24 of the mounting 16 is an earring post member designed 34. The post member 34 may be soldered to the back surface by any known means.

The post member 34 includes a first section 36 having a longitudinal axis, said section is preferably solid and extends outward from the plane of the surface 24. The post member 34 is bent forming bend 38 which extends into a second section 40 that is bent normal to the axes of the first section. The second section 42 also has an elongated axis.

The second section 40, as best seen in FIG. 1, is provided with a bore 42 that extends from end 44 of the second section 40 through the outer side 46 of bend 38. The bore 42 is preferably oval as seen in FIG. 2. Where the bore exits the outer side 46, the outer side surrounding the bore 42 is cut out forming an enlarged recess 48 the purpose of which is to be explained.

The bore 42 is to received a shiftable locking member designated 50. The member includes resilient wire that is preferably bent upon itself forming two elongated holding wires sections 52. The cross section of the sections 52 is preferably as shown in FIG. 2 where the respective interior surfaces 54 and 56 are flat and the exterior surfaces are generally semi-circular.

It is also preferred that the bend 58 of the member 50 is canted to one side from a longitudinal axis that extends through the resilient wires.

In addition each of the wire sections 52 are slightly bowed along their longitudinal axis so that there is assured an interference and drag as the shiftable locking member 50 moves into the bore 42.

Once the shiftable locking member 50 is inserted into the bore 42 the ends 60 of the wire section 52 opposite the bend 58 are each provided with round solder stop tabs 62 to prevent the shiftable locking member 50 from being removed from the bore 42. Another embodiment includes a single enlarged stop tab 62 that may be soldered to both ends 60 of wire section 52.

As can be seen by the drawings the length of the preferred wire sections 52 is greater than the length of the bore 42.

In operation, the shiftable locking member is moved to the position seen in FIG. 4 where it extends outward from end 44. With the sections 52 extended the canted bend 58 will fit within the recess 48. Such a fit will assure a smooth transition of movement of the earring 10 into and through the ear lobe opening 14.

With the wire sections 52 extended the wearer inserts the tab or tabs 62, wire sections 52 and the second section 40 through the opening 14 in the ear lobe 12.

Once the locking and holding member 32 is inserted into the lobe 12 the earring 10 is pushed upward so the bend 38 will slide through the opening 14 and the first section 36 will move into the opening 14 as best seen in FIG. 1. When the position of FIG. 1 is reached the locking member 50 is in the ghost line position of FIG. 1. It is then pushed upwardly so that a position of the wire sections 52 will project from the recess 48. This as can be seen in FIGS. 1 and 3 will assure almost an equal portion of the wires 52 and the second section 40 and they will be biased against the inside surface 64 of the lobe 12. In this way the earring 10 is locked in place and with the bowed wire sections they will be fictionally retained within the bore 42. While the shiftable locking member 50 is preferably the folded wire having two bowed sections 52, the shiftable member could be a solid rod without departing from the spirit of the invention.

In addition the cross sectional shape of the wire sections 52 do not require that the interior surfaces 54 and 56 be flat.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A single post and locking means for a pierced earring, said earring including a base member on the outside of an ear lobe with said single post and locking means passing into and through said ear lobe, said invention comprising:

a post member including a first section having an end secured to said base member on the outside of said ear lobe, and a second section bent normal to said first section having an elongated axis and a bore is provided extending from an end of said second section through said bend between said first and second sections; and a slidable locking member associated with said second section movable from an ear insertion position to a locking position engaging the rear surface of said ear lobe.

2. A single post and locking means as defined in claim 1 wherein:

said slidable locking member is a rod that is mounted within said bore that projects through said end and through said bend; and stop means are provided on each end of said rod to prevent dislodgement from said second section.

3. A single post and locking means as defined in claim 2 wherein:

said slidable locking member is a resillient wire that is bent in two forming two elongated wire sections with each wire section bowed away from the other along their lengths adapted to bias against said bore to increase friction and prevent unwanted sliding.

4. A single post and locking means as defined in claim 1 wherein:

said slidable locking member for insertion into said ear is moved to project as far as possible outward of said end and upon passage through said ear said earring is moved at a 90 degree angle to insertion wherein said second section lays parallel to said rear surface of said ear lobe; and said slidable locking member is adapted to be slideably moved from said insertion position to extend outward of said bend and rest against said rear surface of said ear lobe.

5. A single post and locking means as defined in claim 3 wherein:

said wire includes a bend between said two elongated wire sections, which bend is wider that the combined thickness of said two elongated wire sections to act as a stop for said wires as they move within said bore.

6. A single post and locking means as defined in claim 5 wherein:

an enlarged recess is formed around said bore that exits from said bend, said recess being of such a size to accommodate said bend whereby said bend between said first and second section of said post way pass relatively free through said bore in said ear lobe.

* * * * *